US005584948A

United States Patent [19]

Huron

[11] Patent Number: 5,584,948

[45] Date of Patent: Dec. 17, 1996

[54] METHOD FOR REDUCING THERMALLY INDUCED POROSITY IN A POLYCRYSTALLINE NICKEL-BASE SUPERALLOY ARTICLE

[75] Inventor: Eric S. Huron, West Chester, Ohio

[73] Assignee: General Electric Company, Cincinnati, Ohio

[21] Appl. No.: 308,187

[22] Filed: Sep. 19, 1994

[51] Int. Cl.[6] ..... C22F 1/10

[52] U.S. Cl. ..... 148/556; 148/514; 148/675; 419/2; 419/12; 419/28; 419/42

[58] Field of Search ..... 419/12, 28, 29, 419/33, 61, 66, 2; 148/675, 556, 514

[56] References Cited

U.S. PATENT DOCUMENTS

| | | | |
|---|---|---|---|
| 4,047,933 | 9/1977 | Larson et al. | 75/331 |
| 4,140,528 | 2/1979 | Hebeisen et al. | 148/410 |
| 4,719,080 | 1/1988 | Duhl et al. | 420/443 |
| 4,888,064 | 12/1989 | Chang | 148/410 |
| 4,957,567 | 9/1990 | Krueger et al. | 148/676 |
| 5,061,324 | 10/1991 | Chang | 148/675 |
| 5,143,563 | 9/1992 | Krueger et al. | 148/410 |
| 5,393,483 | 2/1995 | Chang | 148/410 |

OTHER PUBLICATIONS

"The Spray Forming of Superalloys" by H. C. Fieldler, T. F. Sawyer, R. W. Kopp and A. G. Leatham Journal of Metals Aug. 1987 pp. 28–33.

Garosshen et al., "Effects of B, C, and Zr on the Structure . . . Superalloy", met. Trans.; vol. 18 A (Jan. 1987) pp. 69–77.

Hack et al., "Comparison of Nimonic Alloy . . . Solvus"; Proc. of the Metal Powder Report Conf. (Nov. 18–20, 1980); pp. 20–1–20–50.

*Primary Examiner*—David A. Simmons
*Assistant Examiner*—Margery S. Phipps
*Attorney, Agent, or Firm*—Andrew C. Hess; David L. Narciso

[57] ABSTRACT

A method is provided for reducing the tendency for thermally induced porosity within a $\gamma'$ precipitation strengthened nickel-base superalloy which has been processed to obtain a uniform and coarse grain microstructure. This method is particularly useful for forming components such as gas turbine compressor and turbine disk assemblies in which optimal mechanical properties, such as low cycle fatigue and creep resistance, are necessary for operating at elevated temperatures within a gas turbine engine. The method generally entails alloying a $\gamma'$ precipitation strengthened nickel-base superalloy to have a boron content of not more than about 0.02 weight percent, and then forming a billet by melting an ingot of the superalloy in an argon gas atmosphere and atomizing the molten superalloy using argon gas. The above atomizing technique encompasses both powder metallurgy and spray forming processes.

10 Claims, 2 Drawing Sheets

METHOD FOR REDUCING THERMALLY INDUCED POROSITY IN A POLYCRYSTALLINE NICKEL-BASE SUPERALLOY ARTICLE

This invention relates to methods for processing nickel-base superalloys. More particularly, this invention is directed to a method for producing a polycrystalline article from a γ" precipitation strengthened nickel-base superalloy, in which the formation of thermally induced porosity in the superalloy during supersolvus heat treatment is minimized, so as to enhance the overall physical properties of the article, such as particularly low cycle fatigue resistance.

BACKGROUND OF THE INVENTION

Gamma prime (γ') precipitation strengthened nickel-base superalloys are widely used in gas turbine engines because they exhibit a desirable balance of creep, tensile and fatigue crack growth properties at elevated temperatures. γ' precipitation strengthened nickel-base superalloys are distinguishable from other nickel-base superalloys not only by their γ' phase, but also by the applications for which they are particularly suited. For example, the γ" precipitation strengthened nickel-base superalloys taught by U.S. Pat. No. 5,143,563 to Krueger et al., assigned to the same assignee of the present invention, are adapted to form polycrystalline articles such as turbine disks, in which a particular grain size distribution is necessary in order to achieve required mechanical properties at elevated temperatures.

Such superalloys derive desirable properties from the presence of precipitates and alloying constituents at the grain boundaries of the alloy. As an example, boron and carbon form borides and carbides at the grain boundaries of such nickel-base superalloys, which advantageously serve to promote crack growth resistance and time dependent properties, and are therefore typical alloying constituents for superalloys used to form turbine disks. Notably, boron is required in turbine disks in order to achieve adequate dwell fatigue crack growth resistance and creep resistance at elevated temperatures.

In contrast, nickel-base superalloys such as those taught by U.S. Pat. No. 4,719,080 to Duhl et al. and U.S. patent application Ser. No. 08/270,528 to Wukusick et al., the latter being assigned to the same assignee of this invention, are directed to single crystal articles, such as turbine blades. Because such articles are intended to lack grain boundaries, precipitates and alloying constituents which have a beneficial effect when present at the grain boundary are generally unnecessary and possibly undesirable. For example, nickel-base superalloys used to form single crystal articles often intentionally exclude carbon and boron as constituents.

To achieve optimal properties in γ' precipitation strengthened nickel-base superalloys, components such as turbine disks are typically formed by powder metallurgy methods which entail a consolidation step, such as extrusion consolidation. The resulting billet is then isothermally forged at temperatures slightly below the alloy's γ' solvus temperature to approach superplastic forming conditions, and thereby promote filling of the die cavity. These processing steps are designed to retain a fine grain size within the material, avoid fracture during forging, and maintain relatively low forging loads.

In order to improve the fatigue crack growth resistance and mechanical properties of the resultant forged article at elevated temperatures, the article undergoes a heat treatment above the superalloy's γ' solvus temperature (generally referred to as supersolvus heat treatment), during which significant, uniform coarsening of the grains occurs. At such high heat treatment temperatures, the γ' phase is dissolved but then later reprecipitated upon quenching of the forged article.

As the material requirements for gas turbine engines have increased, various processing methods have been suggested to enhance the mechanical properties of the components. For example, components such as turbine disks have been processed to have coarser grains on the order of about ASTM 9 and coarser, particularly at the rim of the disk, in order to enhance their high temperature properties. (Reference throughout to ASTM grain sizes is in accordance with the standard scale established by the American Society for Testing and Materials.) To maximize the mechanical properties of such components, grain sizes within the component must be generally uniform, preferably limited to a range of several ASTM units.

In addition, compositions for γ' precipitation strengthened nickel-base superalloys have also been tailored to optimize properties at elevated temperatures. For example, advanced high strength nickel-base superalloys typically have been alloyed to attain high volume fractions of the γ" phase, on the order of 40 volume percent and more, necessitating a higher heat treatment temperature to dissolve the γ" phase.

The fine nickel-base superalloy powders required to produce components having optimal properties are typically prepared using an argon-atomizing process, which generally involves melting ingots of a superalloy in an argon gas atmosphere, and then atomizing the liquid metal using argon gas. While argon-atomizing methods have distinct advantages over other powder production techniques, the billet produced by consolidation of the powder may contain entrapped gaseous argon.

The entrapped argon later expands during the high temperature supersolvus heat treatment to form gas bubbles or pores in the forged article, an undesirable condition termed thermally induced porosity (TIP). These pores are often associated with grain boundaries, depending on their mechanism of formation. The pores significantly reduce the low cycle fatigue properties of the forged article by serving as preferential sites for crack initiation. For reasons not entirely understood, certain γ' precipitation strengthened nickel-base superalloys are particularly vulnerable to thermally induced porosity.

In the past, porosity in numerous types of alloys has been reduced by employing hot isostatic pressing (HIP) techniques. HIP processes serve to eliminate internal voids and microporosity through a combination of plastic deformation, creep and diffusion, the result of which produces a denser article. However, hot isostatic pressing complicates the processing of the article, adds undesirable costs to processing, and may not always sufficiently reduce porosity for more demanding applications.

Accordingly, it would be desirable if a method were available by which the tendency for thermally induced porosity could be significantly reduced. In particular, such a method would retain the desirable argon-atomizing process by which a fine superalloy powder is formed, yet would reduce the tendency for argon entrapped in the superalloy to expand during supersolvus heat treatment. In addition, such a method would be compatible with the production of nickel-base superalloy articles such as turbine disks, in which a uniform coarse grain microstructure is necessary to achieve desirable mechanical properties at elevated temperatures.

SUMMARY OF THE INVENTION

It is an object of this invention to provide a method for producing a polycrystalline article from a γ' precipitation strengthened nickel-base superalloy, wherein processing of the superalloy includes an argon-atomizing technique.

It is a further object of this invention that such a method entail steps which minimize the tendency for argon entrapped in the superalloy to expand and create thermally induced porosity within the article during supersolvus heat treatment.

It is another object of this invention that such a method entail a reduced boron content in the superalloy for the purpose of minimizing thermally induced porosity within the article.

It is yet an another object of this invention that such a method be specifically tailored for γ' precipitation strengthened nickel-base superalloys having a γ' content of at least about 40 volume percent, for the purpose of forming turbine disks which can serve, after appropriate heat treatment, at elevated temperatures of up to about 1500° F.

The present invention provides a method for reducing the tendency for thermally induced porosity within a γ' precipitation strengthened nickel-base superalloy, and particularly those which have been processed to form a polycrystalline article having a uniform and coarse grain microstructure. This method is particularly useful for forming components such as gas turbine compressor and turbine disk assemblies in which optimal mechanical properties, such as low cycle fatigue and creep resistance, are necessary for operating at elevated temperatures within a gas turbine engine.

The method of this invention generally entails alloying a γ' precipitation strengthened nickel-base superalloy to have a boron content of not more than about 0.02 weight percent. A billet is then formed by melting and atomizing an ingot of the superalloy. The above atomizing technique encompasses powder metallurgy and spray forming processes, both of which are generally conducted in an argon gas atmosphere and employ argon as an atomizing medium. Because the billet is formed using an argon-atomizing technique, gaseous argon may be entrapped within its microstructure.

The billet is then worked at a temperature below the γ' solvus temperature of the superalloy so as to form an article characterized by γ' precipitates and a pre-heat treatment density. As used herein, the pre-heat treatment density is generally indicative of the presence of porosity (typically a negligible amount) in the article prior to heat treating the article at a temperature above the γ' solvus temperature of the superalloy. This heat treatment is conducted for a duration sufficient to solution substantially all of the γ' precipitates and to coarsen the grains of the article, preferably on the order of at least about ASTM 8. During this heat treatment exposure, porosity in the article increases as entrapped argon expands, corresponding to a decrease in density of the article.

Thereafter, the article is cooled at a rate sufficient to reprecipitate γ' within the article. Upon cooling, the article is characterized by a post-heat treatment density, which is indicative of the presence of porosity in the article following the supersolvus heat treatment. Because porosity increases in the article during the heat treatment, the post-heat treatment density will be less than the pre-heat treatment density. However, in accordance with this invention, the formation of thermally induced porosity and the resulting decrease in density of the article is significantly reduced by appropriately controlling the amount of boron in the superalloy to that noted above. The level of thermally induced porosity is evidenced by a reduction in the density in the article which occurs during the heat treatment step, as indicated by the post-heat treatment density being less than the pre-heat treatment density. Notably, the above alloying and processing steps result in a quantifiable difference between the post-heat treatment density and the pre-heat treatment density of about 0.3 percent or less, as compared to the pre-heat treatment density. Thermally induced porosity corresponding to a density decrease of 0.3 percent or less is generally considered to be acceptable in terms of the effect which such porosity will have on the mechanical properties of the article.

In view of the above, the method of this invention results in polycrystalline superalloy articles characterized by a combination of high strength and tolerance to defects, and are suitable for use at temperatures of up to about 1500° F. Yet, due to an improved resistance to thermally induced porosity, the superalloy articles are characterized by enhanced low cycle fatigue characteristics and mechanical properties at elevated temperatures. Consequently, lower part rejection and scrap rate during production are achieved by lower levels of thermally induced porosity being present in such articles.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE INVENTION

For γ' precipitation strengthened nickel-base superalloys, aluminum and titanium are the principal elements which combine with nickel to form the desired amount of γ' precipitate, principally $Ni_3(Al,Ti)$. The elements nickel, chromium, tungsten, molybdenum and cobalt are the principal elements which combine to form the γ matrix. The principal high temperature carbide formed is of the MC type, in which M is predominantly niobium, zirconium and titanium. With this type of alloy, preferred processing methods typically include working parameters and a supersolvus heat treatment which produce a polycrystalline article having a uniform grain size that is preferably on the order of about ASTM 8 and coarser.

A preferred superalloy for illustrating the method and processing features of this invention is the KM4 superalloy taught in U.S. Pat. No. 5,143,563 to Krueger et al. As disclosed by Krueger et al., the KM4 alloy has a nominal composition, in weight percent, of about 17.0 to about 19.0 cobalt, about 11.0 to about 13.0 chromium, about 3.5 to about 4.5 molybdenum, about 3.5 to about 4.5 aluminum, about 3.5 to about 4.5 titanium, about 1.5 to about 2.5 niobium, up to about 0.06 zirconium, about 0.01 to about 0.06 carbon, and about 0.01 to about 0.04 boron, with the balance being essentially nickel and incidental impurities. The γ' solvus temperature of this alloy is estimated to be in the range of about 2140° F. to about 2150° F. The calculated γ' content for KM4 is generally on the order of about 54 volume percent.

Although KM4 is a preferred alloy, the teachings of this invention are believed to be applicable to γ' precipitation strengthened nickel-base superalloys in general. In particular, the advantages of this invention appear to be most apparent for such superalloys having a calculated γ' content of at least about 40 volume percent.

As noted previously, optimal mechanical properties for superalloys such as KM4 are typically achieved by preparing a fine powder using an argon-atomizing process, in which superalloy ingots are melted in an argon gas atmosphere, and the liquid metal then atomized using argon gas. However, and as noted previously, billets produced by consolidation of the powder may contain entrapped gaseous argon which expands during the supersolvus heat treatment to create thermally induced porosity within the article formed from the billet. It is highly desirable to reduce the amount of thermally induced porosity within the article due to the detrimental effect which porosity has on low cycle fatigue properties.

Figure 1:
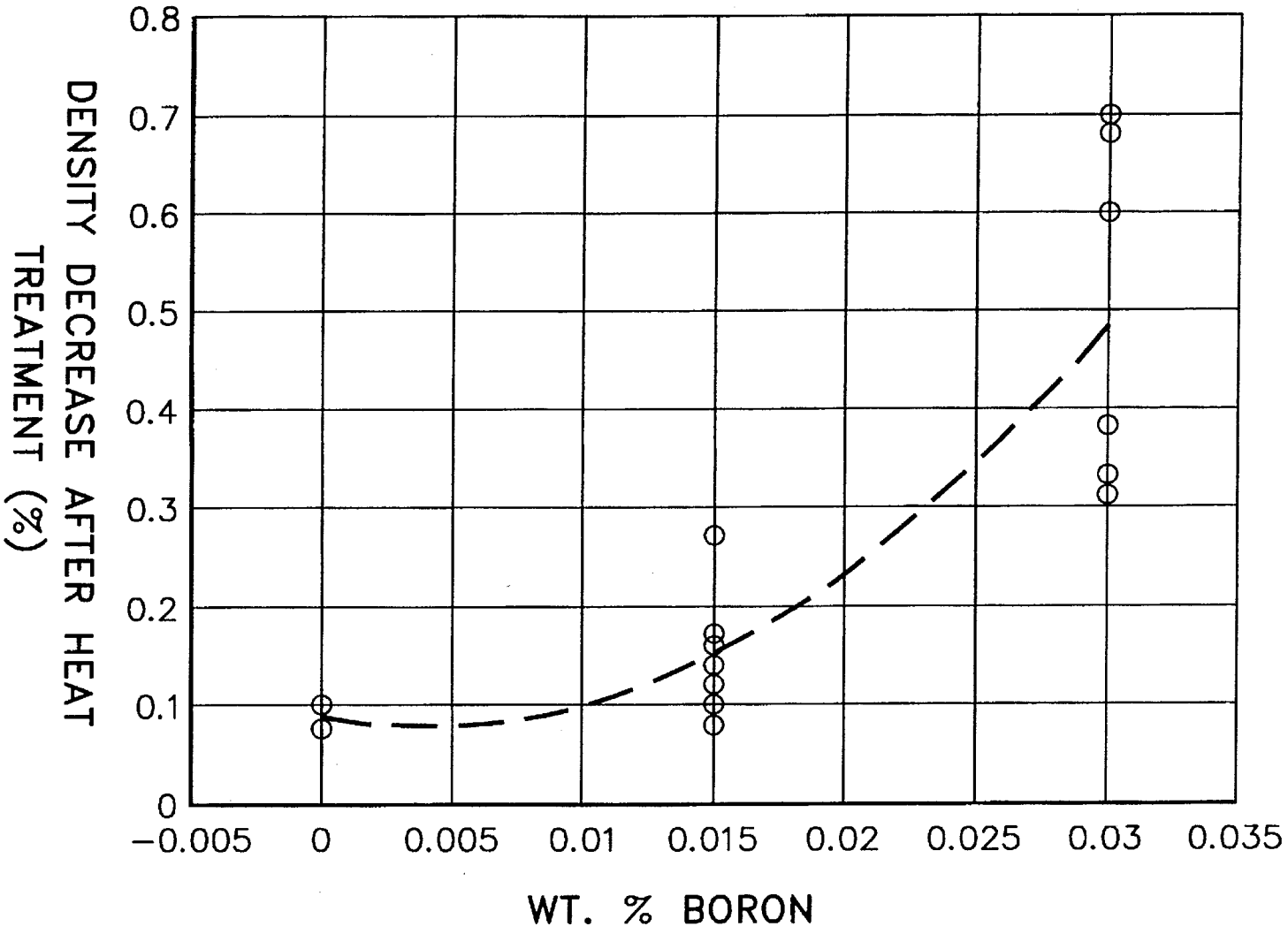
FIG. 1 is a graph which illustrates the effect that boron content has on the decrease in density of an article formed from a γ' precipitation strengthened nickel-base superalloy during heat treatment, in accordance with the teachings of this invention.

As a method by which thermally induced porosity can be inhibited in a γ' precipitation strengthened nickel-base superalloy, the present invention relies on an unexpected influence which the boron content of a γ' precipitation strengthened nickel-base superalloy has on the formation of thermally induced porosity. In particular, and as illustrated in FIG. 1, a reduction of the amount of boron within a γ' precipitation strengthened nickel-base superalloy has been determined to correspond to a lower level of thermally induced porosity formation in an article, as determined by a decrease in the change in density of the article which occurs during a supersolvus heat treatment. It is believed that this interrelationship is a result of the boron, which is present at the grain boundaries of the superalloy, causing localized grain boundary melting during thermal exposure that thereby allows the trapped argon gas within the grain boundary to expand forming a bubble or void within the superalloy article.

As seen from FIG. 1, it appears that a minimum level of thermally induced porosity results if the boron content of a γ' precipitation strengthened nickel-base superalloy is maintained below about 0.015 weight percent. However, those skilled in the art will recognize that conventional teachings have always suggested that boron is a highly desirable alloying constituent for polycrystalline articles formed from γ' precipitation strengthened nickel-base superalloys, such as turbine disks formed from these superalloys, due to boron's beneficial effect on dwell fatigue crack growth resistance and creep resistance at elevated temperatures. Therefore, in practice, conventional teachings have typically suggested a boron content of closer to about 0.03 weight percent.

In accordance with the teachings of this invention, an optimum balance of the competing concerns which are a reduction in thermally induced porosity coupled with maintenance of sufficient fatigue life properties, results in a preferred boron content for a γ' precipitation strengthened nickel-base superalloy of not more than about 0.02 weight percent. Because boron is necessary in turbine disks to achieve adequate dwell fatigue crack growth and creep resistance at elevated temperatures, a more preferred boron content for the superalloy is about 0.01 to about 0.02 weight percent. Limiting the boron content to not more than about 0.02 weight percent has resulted in thermally induced porosity of less than about 0.3 percent, which is an acceptable level for achieving the desired mechanical properties required for turbine disks used in gas turbine engines.

While the influence which boron content has on the incipient melting of γ' precipitation strengthened nickel-base superalloys is known to those skilled in the art, this influence occurs at significantly higher temperatures than those endured during supersolvus heat treatment, at which thermally induced porosity arises. Accordingly, it was unexpected that the boron content of a γ' precipitation strengthened nickel-base superalloy would influence the mechanism for thermally induced porosity in such an alloy when exposed to its supersolvus temperatures. Furthermore, the 0.02 weight percent maximum level for boron is well below the 0.03 weight percent level typically sought and maintained for these types of nickel-base superalloys.

In accordance with known practices, the preferred processing method of this invention generally entails an argon-atomizing technique by which a fine powder is formed. A billet having a grain size of less than about ASTM 10 to 12 is then formed from the superalloy powder in order to achieve optimum superplasticity. Notably, entrapped argon within the superalloy is generally the result of argon being present during the powder metallurgy process, such that billets formed by cast and wrought methods would generally not benefit from the method of this invention. However, spray forming techniques which employ argon as the spray medium and/or the inert atmosphere will also tend to have entrapped argon, and therefore such techniques also benefit from the teachings of this invention.

The billet is then worked so as to form an article having a desired geometry. Preferably, local strain rates are maintained below a critical strain rate in accordance with U.S. Pat. No. 4,957,567 to Krueger et al., assigned to the assignee of this invention. As noted with the teachings of Krueger et al., the critical strain rate, $\xi_c$, during working is composition, microstructure and temperature dependent, and can be determined for a selected alloy by deforming test samples under various strain rate conditions, and then heating the samples above the γ' solvus temperature and below the alloy's incipient melting temperature. The supersolvus solution temperature employed to heat treat an alloy is typically about 30° F. to about 50° F. above the alloy's γ' solvus temperature, in order to compensate for furnace temperature variations. $\xi_c$ is then defined as the strain rate which, when exceeded during the deformation and working of a superalloy article and accompanied by a sufficient amount of total strain, will result in critical grain growth after supersolvus heat treatment.

After hot working, the article is fully solutioned, except for any high temperature carbides, at or above the superalloy's solvus temperature. As noted above, the heat treatment temperature is typically at least about 30° F. above the alloy's solvus temperature, with this temperature being maintained for a duration of about 1 hour. During this supersolvus heat treatment, the worked grain structure recrystallizes and coarsens uniformly to a desired grain size. For optimum mechanical properties, uniform grain sizes within a range of about 2 or 3 ASTM units are desirable. Generally, grain sizes in excess of about 2 to 3 ASTM units coarser than the desired grain size range are undesirable due to their detrimental effect on low cycle fatigue resistance and other mechanical properties of an article, such as tensile and fatigue strength.

As previously discussed, the supersolvus exposure also results in the formation of thermally induced porosity. To facilitate processing, it would be advantageous if the heat treatment temperature range above the γ' solvus temperature could be increased without further promoting the tendency for porosity to develop during heat treatment. The lower boron content of this invention advantageously results in a higher incipient melting temperature for the superalloy, and therefore permits the supersolvus heat treatment to be performed at higher temperatures without further promoting porosity in the alloy.

Following the supersolvus heat treatment, the cooling rate is then appropriately controlled to reprecipitate γ' within the γ matrix, so as to achieve the particular mechanical properties desired. The article is preferably air cooled for a brief period on the order of a few seconds to a few minutes, and then quenched in oil or another suitable medium so as to reprecipitate γ' within the article, as is known in the art. Thereafter, the article may be aged using known techniques with a short stress relief cycle at a temperature above the aging temperature of the alloy if necessary to reduce residual stresses. As is known by those skilled in the art, such stress relief has the added benefit of improving long term carbide stability during service. The resulting article generally has a stabilized microstructure and an enhanced, attractive balance and combination of tensile, creep, stress rupture, low cycle fatigue and fatigue crack growth properties, particularly for use from ambient up to a temperature of about 1500° F. The aging process required for a particular material and properties would be known to one skilled in the art and will not discussed further.

Figure 2:
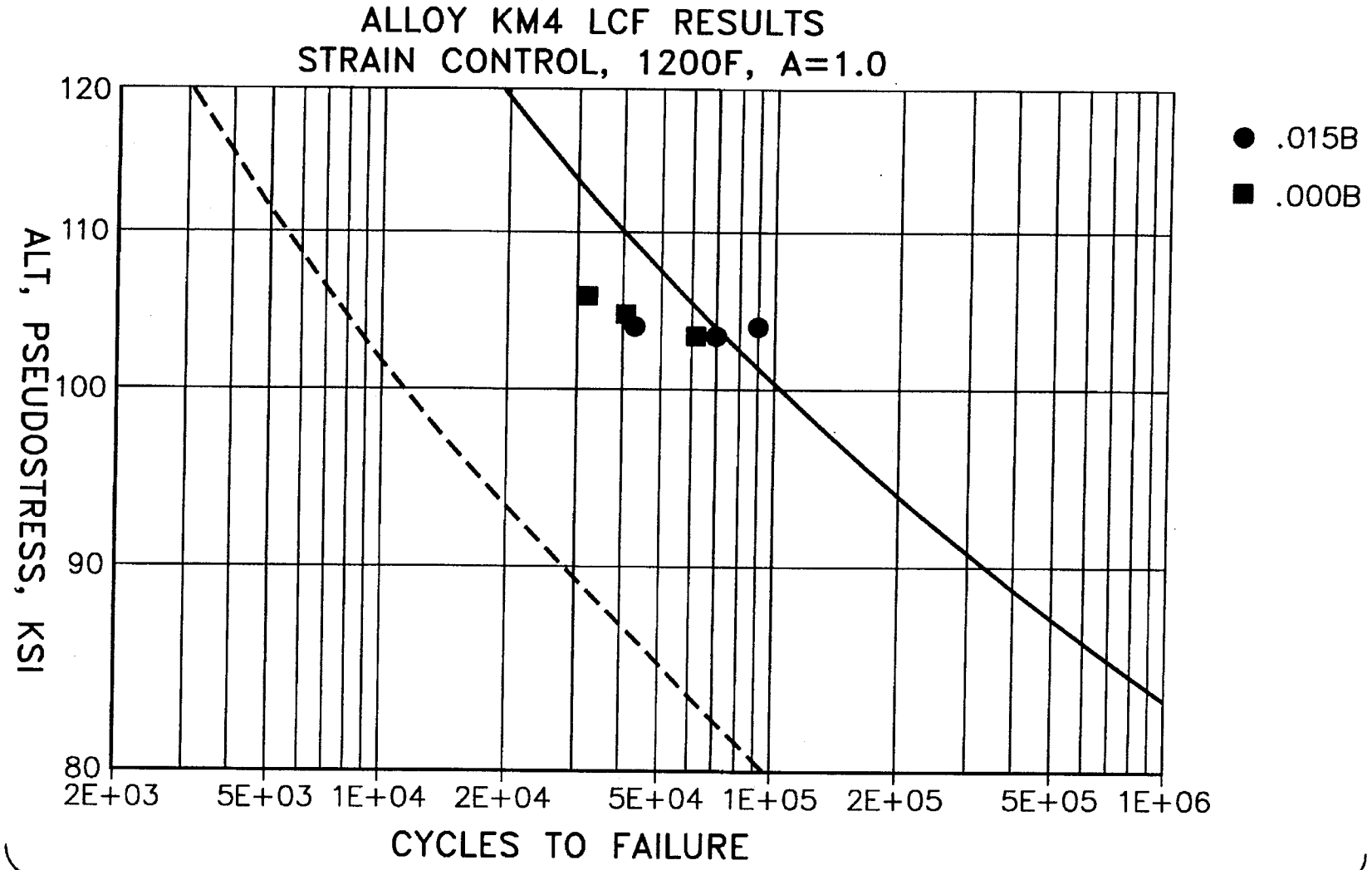
FIG. 2 is a graph which illustrates the effect that boron content has on the low cycle fatigue characteristics of the superalloy.

FIG. 2 dramatically illustrates the improved low cycle fatigue capability of a γ' precipitation strengthened nickel-base superalloy which has been modified in accordance with the present invention. The results of tests performed on specimens represented in FIG. 2 were based on the KM4 superalloy noted above. Specimens were prepared in the form of smooth polished cylindrical bars tested in strain control using methods known in the art.

The specimens were generally categorized into one of two groups. The composition of one group of specimens, whose test results are identified by the broken line in FIG. 2, fell within the compositional range for KM4 noted above, with the boron content being about 0.030 weight percent. The composition of the second group of specimens, identified by the solid line and symbols, also fell within the composition ranges noted above, with the exception that each had a reduced level of boron as compared to the first group. Other than their intended compositional variations and the processing modifications noted below, specimens of both groups were processed identically as described above from a billet formed by consolidating a fine powder produced by a conventional argon-atomizing technique.

To establish a baseline, most of the specimens of the first group of superalloys were given a supersolvus heat treatment in air at a temperature of about 2170° F. to about 2180° F., which is on the order of about 30° F. above their solvus temperature, followed by rapid cooling. The remaining specimens of this group were processed in an attempt to determine the effect of hot isostatic pressing on the amount of thermally induced porosity formed during a supersolvus heat treatment. These specimens underwent a hot isostatic pressing cycle at a temperature of about 2170° F. to about 2180° F. (i.e., about 30° F. above their solvus temperature), followed by rapid cooling. Again, the results from testing all of the specimens within the first group are represented by the broken line in FIG. 2.

Each of the specimens alloyed to have a lower boron content in accordance with this invention also underwent a supersolvus heat treatment and air cooling process, essentially identical to that noted above. The specimens represented by the circles in FIG. 2 were alloyed to have a boron content of about 0.015 weight percent, while the specimens represented by the squares were alloyed to be essentially free of boron.

As can be seen from the results depicted in FIG. 2, those specimens alloyed to have reduced levels of boron exhibited superior low cycle fatigue properties as compared to those specimens alloyed to contain the conventional level of about 0.030 weight percent boron. Notably, use of hot isostatic pressing improved the low cycle fatigue characteristics of the superalloy over that of the baseline specimens, but not nearly to the extent made possible by lowering the boron content as done with the second group of specimens. Furthermore, variations in the carbon content did not have any notable effect on the low cycle fatigue properties of any of the superalloy specimens.

From the above, it can be seen that the method of this invention makes possible the production of components from a γ' precipitation strengthened nickel-base superalloy which exhibit significantly improved low cycle fatigue properties. More specifically, the method of this invention significantly promotes low cycle fatigue properties by reducing the formation of thermally induced porosity in a polycrystalline article formed from a γ' precipitation strengthened nickel-base superalloys.

In accordance with this invention, it has been determined that thermally induced porosity can be controlled and reduced by limiting the boron content of such superalloys below that conventionally employed to achieve desirable properties in this type of nickel-base superalloy.

In addition, the method of this invention achieves such desirable results while permitting the use of powder metallurgy techniques which employ argon as the atomizing medium and atmosphere. Consequently, the advantages associated with forming high strength gas turbine engine components, such as turbine disks, from superalloy powders are retained while overcoming a significant disadvantage recognized with argon-atomizing techniques. The method of this invention is also compatible with other conventional processing techniques known in the art for the manufacture of polycrystalline articles from γ' precipitation strengthened nickel-base superalloys.

Accordingly, the method of this invention serves to optimize the resultant worked microstructure of a polycrystalline article formed from γ' precipitation strengthened nickel-base superalloy. The method of this invention is particular well suited for producing articles whose microstructure is characterized by a uniform and coarse grain structure, in which it is desired that grain size be controlled within a range of not more than a few ASTM units. Notably, coarser grains in an article reduces the total grain boundary surface area available to accommodate the boron content of the superalloy. Accordingly, reducing the amount of boron in a superalloy in accordance with this invention is particularly compatible with the forming of articles whose grain size is about ASTM 8 and coarser. Notably, a boron content of less than the approximate 0.01 weight percent preferred minimum may be desirable or necessary for articles having coarser grains, e.g., ASTM 5 and coarser, in order to achieve the benefits of the present invention.

The method of this invention is also potentially applicable to a wide range of starting input materials, including hot compacted powder, fine grain powder metal billet, and coarse grain powder metal billet produced by supersolvus heat treatment of fine grain billet. In addition, the composition of the γ' precipitation strengthened nickel-base superalloy may vary widely so as to include alloys of this type having calculated high volume fractions of γ' content, and particularly those having a calculated γ' content of at least about 40 volume percent.

It is foreseeable that other processing techniques for high volume fraction γ' superalloys, besides the powder metallurgy and hot forging operations disclosed, may be employed. In particular, the teachings of this invention are applicable to spray forming methods in which argon is employed as a spray medium and/or the inert atmosphere. In addition, it is foreseeable that these teachings can be extended to other applications requiring enhanced properties at temperatures ranging from ambient up to about 1500° F.

While our invention has been described in terms of a preferred embodiment, it is apparent that other forms could be adopted by one skilled in the art, such as by substituting other appropriate γ' precipitation strengthened nickel-base superalloys, or by modifying the preferred method by substituting other processing steps or including additional processing steps. Accordingly, the scope of our invention is to be limited only by the following claims.

What is claimed is:

1. A method for forming a polycrystalline article from a γ' precipitation strengthened nickel-base superalloy having a γ' solvus temperature of at least about 2140° F. and a calculated γ' content of at least about 40 volume percent, the method comprising the steps of:

alloying the superalloy to have a boron content of not more than about 0.015 weight percent;

forming a fine-grained billet by melting an ingot of the superalloy in an argon gas atmosphere and then atomizing the superalloy using argon gas, such that the billet has gaseous argon entrapped within its microstructure;

working the billet at a temperature below the γ' solvus temperature of the superalloy so as to form the article, the article being characterized by γ' precipitates and a pre-heat treatment density, the pre-heat treatment density being indicative of the presence of porosity in the article prior to heat treating;

heat treating the article to a temperature above the γ' solvus temperature of the superalloy for a duration sufficient to solution substantially all of the γ' precipitates and to coarsen the grains of the article;

cooling the article at a rate sufficient to reprecipitate γ' within the article, the article being characterized by a post-heat treatment density indicative of the presence of porosity in the article after heat treating;

wherein thermally induced porosity in the article is indicated by a reduction in density in the article during the heat treatment step as evidenced by the post-heat treatment density being less than the pre-heat treatment density, and, without hot isostatic pressing the article following the heat treating step, the difference between the post-heat treatment density and the pre-heat treatment density is about 0.3 percent or less of the pre-heat treatment density.

2. A method as recited in claim 1 wherein the forming step comprises producing a powder from the superalloy and consolidating the powder to form the billet.

3. A method as recited in claim 1 wherein the forming step comprises a spray forming process.

4. A method as recited in claim 1 wherein the working step comprises an isothermal forging operation.

5. A method as recited in claim 1 wherein the grains of the turbine disk after the heat treating step have a grain size of at least about ASTM 8.

6. A method as recited in claim 1 wherein the superalloy consists essentially of, in weight percent, about 17.0 to about 19.0 cobalt, about 11.0 to about 13.0 chromium, about 3.5 to about 4.5 molybdenum, about 3.5 to about 4.5 aluminum, about 3.5 to about 4.5 titanium, about 1.5 to about 2.5 niobium, up to about 0.06 zirconium, about 0.01 to about 0.06 carbon, and not more than about 0.015 boron, with the balance being essentially nickel and incidental impurities.

7. A method as recited in claim 1 further comprising the step of heating the article after the cooling step to a temperature and for a duration sufficient to stabilize the microstructure of the so as to render the article suitable for use at elevated temperatures of up to about 1500° F.

8. A method for forming a turbine disk from a γ' precipitation strengthened nickel-base superalloy having a γ' solvus temperature of about 2140° F. or more and a calculated γ' content of at least about 40 volume percent, the method comprising the steps of:

producing a powder from the superalloy using an atomizing process which includes melting an ingot of the superalloy in an argon gas atmosphere and then atomizing the superalloy using argon gas, the superalloy having a boron content of about 0.01 to about 0.015 weight percent;

forming a fine-grained billet from the powder, the billet having gaseous argon entrapped within its microstructure;

isothermally forging the billet at a temperature below the γ' solvus temperature of the superalloy so as to form the turbine disk, the turbine disk being characterized by γ' precipitates and a pre-heat treatment density, the pre-heat treatment density being indicative of the presence of porosity in the turbine disk prior to heat treating;

heat treating the turbine disk to a temperature above the γ' solvus temperature of the superalloy for a duration sufficient to solution substantially all of the γ' precipitates and to coarsen the grains of the turbine disk to a grain size of at least about ASTM 8;

cooling the turbine disk at a rate sufficient to reprecipitate γ' within the turbine disk, the turbine disk being characterized by a post-heat treatment density indicative of the presence of porosity in the turbine disk alter heat treating;

wherein thermally induced porosity in the turbine disk is indicated by a reduction in density in the turbine disk during the heat treatment step as evidenced by the post-heat treatment density being less than the pre-heat treatment density, and, without hot isostatic pressing the article following the heat treating step the difference between the post-heat treatment density and the pre-heat treatment density is about 0.3 percent or less of the pre-heat treatment density.

9. A method as recited in claim 8 wherein the superalloy consists essentially of, in weight percent, about 17.0 to about 19.0 cobalt, about 11.0 to about 13.0 chromium, about 3.5 to about 4.5 molybdenum, about 3.5 to about 4.5 aluminum, about 3.5 to about 4.5 titanium, about 1.5 to about 2.5 niobium, up to about 0.06 zirconium, about 0.01 to about 0.06 carbon, and not more than about 0.015 boron, with the balance being essentially nickel and incidental impurities.

10. A method as recited in claim 8 further comprising the step of heating the turbine disk after the cooling step to a temperature and for a duration sufficient to stabilize the microstructure of the turbine disk, so as to render the turbine disk suitable for use at elevated temperatures of up to about 1500° F.

* * * * *